US010556715B2

(12) United States Patent
Vicktorius et al.

(10) Patent No.: US 10,556,715 B2
(45) Date of Patent: Feb. 11, 2020

(54) APPARATUS FOR LABELLING INDIVIDUAL PRODUCTS

(71) Applicant: Espera-Werke GmbH, Duisburg (DE)

(72) Inventors: Winfried Vicktorius, Duisburg (DE); Peter Wolff, Swisttal-Heimerzheim (DE); Ulrich Jung, Dortmund (DE)

(73) Assignee: Espera-Werke GmbH, Duisburg (DE)

( * ) Notice: Subject to any disclaimer, the term of this patent is extended or adjusted under 35 U.S.C. 154(b) by 190 days.

(21) Appl. No.: 15/568,776

(22) PCT Filed: Feb. 29, 2016

(86) PCT No.: PCT/EP2016/054221
§ 371 (c)(1),
(2) Date: Oct. 23, 2017

(87) PCT Pub. No.: WO2016/173742
PCT Pub. Date: Nov. 3, 2016

(65) Prior Publication Data

US 2018/0099773 A1 Apr. 12, 2018

(30) Foreign Application Priority Data

Apr. 29, 2015 (DE) ..... 10 2015 106 647

(51) Int. Cl.
*B65C 9/28* (2006.01)
*B65C 9/18* (2006.01)
*B65C 9/00* (2006.01)

(52) U.S. Cl.
CPC ..... *B65C 9/28* (2013.01); *B65C 9/1876* (2013.01); *B65C 2009/0053* (2013.01)

(58) Field of Classification Search
CPC ..... B65C 9/26; B65C 9/28; B65C 9/1876; B65C 9/1815; B65C 9/1884;
(Continued)

(56) References Cited

U.S. PATENT DOCUMENTS 4,046,613 A 9/1977 Kucheck et al.
4,124,436 A 11/1978 Pettis, Jr. et al.
(Continued)

FOREIGN PATENT DOCUMENTS

CN 1101616 A 4/1995
CN 202144312 U 2/2012
(Continued)

OTHER PUBLICATIONS

Office Action dated Mar. 13, 2019 for corresponding Chinese Application No. 201680025888.1.

*Primary Examiner* — John L Goff, II
(74) *Attorney, Agent, or Firm* — Rankin, Hill & Clark LLP

(57) ABSTRACT

The invention relates to a device (1) for labelling individual products (2), in particular packages or goods, with a feed device (3) for transporting a respective product (2) along a transporting path, with a label application device (4) with a blower head (5) for applying a label (6) to the surface of the product (2), wherein the blower head (5) has holding means (7) for fixing the label (6) in a blow-off position (II) and blow-off means (8) for producing a blast of compressed air directed in a blow-off direction (A) from the blow-off position (II) to the feed device (3), and with a label dispensing device (9) for providing a label (6) in a dispensing position (I). In order to precisely transfer labels (6) to a surface of a product (2) to be labelled in the simplest way possible the invention proposes that the label application device (4) comprises a conveying unit (11) for transporting the respective label (6) from the dispensing position (I) to the blow-off position (II), wherein the conveying unit (11) has a transporting element (12) and pressing force generation means (14). The invention also relates to a method of labelling individual products (2).

19 Claims, 3 Drawing Sheets

Figure 1:
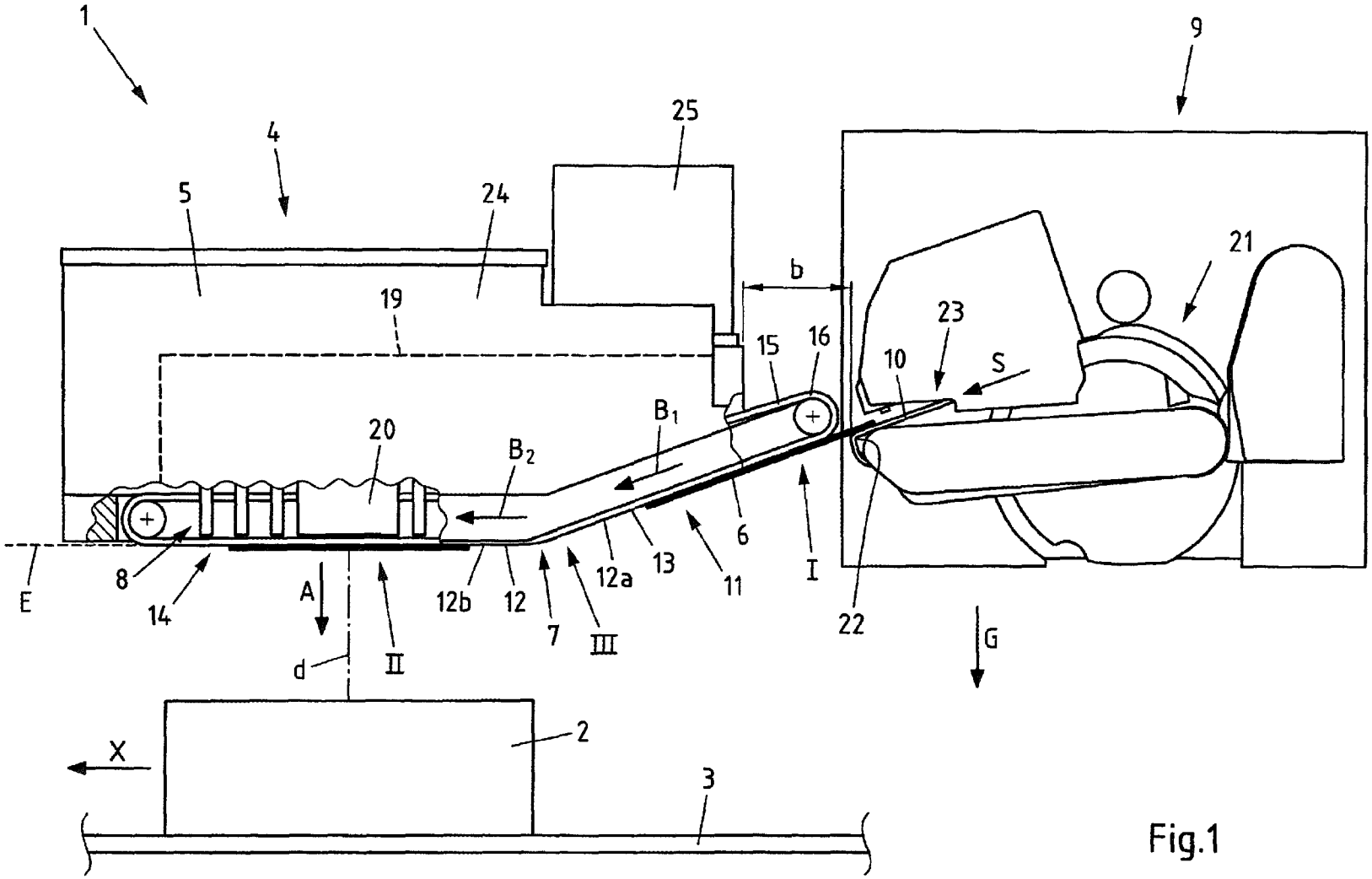

(58) Field of Classification Search
CPC ..... B65C 2009/0053; B29C 65/7847; B23B 31/307; B25B 11/005; B25B 11/007; B23Q 2703/04
USPC ..... 156/DIG. 31, DIG. 38; 269/21; 271/184, 271/185
See application file for complete search history.

(56) References Cited

U.S. PATENT DOCUMENTS

| | | | | |
|---|---|---|---|---|
| 4,612,079 | A | | 9/1986 | Ostrow |
| 4,707,211 | A | | 11/1987 | Shibata |
| 4,784,714 | A | | 11/1988 | Shibata |
| 5,232,540 | A | * | 8/1993 | Southwell ..... B65C 1/021 156/361 |
| 5,624,525 | A | | 4/1997 | Ehara et al. |
| 6,009,926 | A | | 1/2000 | Vicktorius et al. |
| 6,024,149 | A | | 2/2000 | Bernhard et al. |

FOREIGN PATENT DOCUMENTS

| | | | |
|---|---|---|---|
| DE | 2708353 | A1 | 9/1977 |
| DE | 19531426 | A1 | 2/1997 |
| DE | 69214377 | T2 | 4/1997 |
| DE | 102010040009 | A1 | 3/2013 |
| EP | 0105680 | A2 | 4/1984 |
| GB | 1575050 | A | 9/1980 |
| JP | S5392700 | A | 8/1978 |
| JP | H0113051 | Y2 | 4/1989 |
| JP | 2000226018 | A | 8/2000 |
| JP | 2001315732 | A | 11/2001 |
| WO | 03076274 | A1 | 9/2003 |

* cited by examiner

APPARATUS FOR LABELLING INDIVIDUAL PRODUCTS

The present invention relates to a device for labelling individual products, in particular packages or goods, with a feed device for transporting a respective product along a transporting path, with a label application device with a blower head for applying a label to the surface of the product, wherein the blower head has holding means for fixing the label in a blow-off position and blow-off means for producing a blast of compressed air directed in a blow-off direction from the blow-off position to the feed device and with a label dispensing device for the provision of a label in a dispensing position.

The invention also relates to a method of labelling individual products, in particular packages or goods, in which a product is transported with a feed device along a transporting path, wherein on the transporting path the product is moved past a blower head of a label application device, in which labels connected to a material strip are provided in a label dispensing device, wherein one of the labels is dispensed by the label dispensing device in a dispensing position and is detached from the material strip, wherein the label is transferred from the dispensing position into the blower head in a blow-off position and wherein the label is transferred to the product from the blow-off position by means of a blast of compressed air directed in a blow-off direction from the blow-off position to the feed device as soon as the product is located in the blow-off direction in front of the blow-off position.

A device and a method of the type set out in the introduction are known, for example, from EP 0 883 549 B1 and DE 10 2010 040 009 A1. Here, packages are transported by way of a feed device, not specified in further detail, to a label application device, which has a blower head for applying a label to an upper side of the respective package through blowing off. For this the packaging is arranged vertically underneath the blower head in the direction of gravity, i.e. vertically below a section of the blower head with a plurality of suction and blower openings (meaning the outer openings which are used both for suction and blowing). A label stuck to the lower housing section of the blower head in a blow-off position is, as soon as the package is located below the label, blown off by a blast of compressed air emerging from the opening and directed towards the feed device or packaging, and is thereby transferred to the packing. In the meaning of the invention the blow-off position is defined as a position in which the label to be transferred to the product contacts the blower head and is arranged in the effect area of those openings through which the blast of compressed aid emerges/is emitted. This position can vary for differently sized labels.

In the cited prior art the label is held in the blow-off position in the area of the openings through the production of a suction pressure or suction air flow through the openings. The same openings simultaneously act as suction and blower openings. To produce the suction force which presses the label to the underside of the blower head housing in the area of the openings, an under pressure generator is arranged inside the blower head which is in fluidic connection with the openings for the suction process. For blowing off the label in the direction of the packaging an overpressure generator is arranged in the blower head which for a short time can be brought into fluidic connection via a valve with the same openings which previously built up the suction pressure in order to produce the blast of compressed air which transfers the label to the packaging. These definitions of an overpressure generator and an under pressure generator also apply in the case of the present invention.

The known device also has a label dispensing device into which a printing device for printing the labels is integrated. The printed labels are provided in a dispensing position at the outlet of the label dispensing device. In accordance with the invention, the dispensing position is defined as the position in which the respective label is still only adhering in sections to the material strip or is still only partially connected thereto (partially detached state of the label) and protrudes from the label dispensing device. In this prior art, at a dispending edge the material strip with the detachably adhering labels is sharply deflected through which the label become detached from the material strip. The label continues to move in the direction in which the material strip is being transported before being deflected. In the partially detached state of the label, it is on the one hand still held on the material strip, but on the other hand the label is also already in the region of the suction openings through which an under pressure or suction force is being generated. As soon as the label is fully detached from the material strip it is now only held in the area of the suction openings through the under pressure. As has been stated, the subsequent blast of compressed air then transports the label to the product.

For as precise label placement as possible it is important to have the blast of compressed air acting as centrally as possible to the label. Through this it is achieved that the blast of compressed air produces as symmetrical a force distribution over the label surface as possible. In doing so, as in the previously described prior art, it must be taken into account that depending on requirements labels of different sizes are moved from the dispensing position into the blow-off position defined for the label, wherein for each label size the blast of compressed air should act as centrally as possible. In the above-described prior art adaptation of the section with suction and blower opening to different label sizes in the direction from the dispensing position to the blow-off position takes place by means of a manually displaceable pusher element, which can be displaced horizontally in the direction from the dispensing position to the blow-off position or contrary to this direction, wherein several of the openings can be individually closed (blocked) or released. The pusher element is located in the interior of the blower head housing and covers the opening from the inside. In this way adaptation to different label lengths can be achieved.

For adaptation to different label widths the entire blower head can be displaced transversely to the direction from the dispensing position to the blow-off position, through which the section with the openings can be displaced transversely to the dispending position. The latter also takes place manually.

A drawback of the previously described prior art is that an operator has to adjust the blower head or the openings required for the blast of compressed air to each different label size individually and with a high degree of precision. Particularly because of the manual nature of the adjustment this is very laborious.

On the basis of this it is the aim of the invention to create a device and a method of labelling individual products, in particular packages or goods, wherein transferring of labels to the surface to be labelled is possible in as simple a manner as possible.

The previously derived and set out task is achieved in accordance with a first aspect of the present invention in a device for labelling individual products, in particular packages or goods, with a feed device for transporting a respective product along a transporting path (path taken by the product during transporting), with a label application device with a blower head for applying a label to the surface (facing the blower head) of the product, wherein the blower head has holding means for fixing the label in a blow-off position and blow-off means for producing a blast of compressed air in a blow-off direction, particularly directed in the direction of gravity, from the blow-off position to the feed device or surface of the product being transported, and with a label dispensing device for providing a label (partially detached from a material strip) in a dispensing position, wherein the label dispensing device is, in particular, provided with a printing device for printing the respective label, in that the label application device comprises a conveying unit for transporting the respective label from the dispensing position to the blow-off position, wherein the conveying unit has a transporting element (for the dispensed label) and pressing force generation means (for the dispensed label).

As the label application device according to the invention has a conveying unit with a transporter element for the label to be applied and pressing force generation means for the label to be applied, it is possible to mechanically, in particular automatically, collect (pick up) a label at the dispensing position and move it from here into the optimum blow-off position defined for the label. In this way labels of different lengths can also always be aligned precisely at the center of the blast of compressed air or centrally in the area provided with the blow openings (hereinafter also referred to as blow nozzles) for producing the blast of compressed air, in the region of which in accordance with the invention some of the suction openings can be located. Fundamentally it is also conceivable to use some or all of the suction openings themselves to produce the blast of compressed air (through which at the time of the blast of compressed air, blowing takes place instead of suction). The distance from the dispensing position to the blow-off position envisaged for the respective label or the respective label length is dependent on the label length.

This distance can be individually set for each label length and, in particular, programmed into a control device, so that when changing the labels from a first label length to a second label length the label application device can individually and, in particular, automatically, adjust the distance from the dispensing position to the blow-off position and thereby also the blow-off position. Additionally or alternatively adaptation of the position of the label relative to the blow and/or suction openings can take place transversely to the direction in which the label is being supplied to the blower head or the region with the blow and/or suction openings. The latter can take place, for example, in the conventional manner in which the label application device, including blower head and conveying unit, is moved relative to the label dispensing device in said transverse direction (direction at right angles to the blow-off direction and direction in which the label is being supplied to the blow-off position).

A further advantage of the provision of the previously described label application device with a conveying unit is that the transporter element of the conveying unit takes up the label at a point at which the label is still partially connected with the material strip (partially detached state of the label) and supports the complete detachment of the label from the material strip. In the dispensing position the partially detached label is pressed onto the transporter element, in particular though suction, in that the pressing force generation means are operated. The label adhering to the transport element is then moved away from the dispensing position by the transporting element through which the label is completely detached from the material strip. In this way the risk of the label becoming slight twisted with regard to the optimum alignment or even remaining stuck to the material strip during detachment is considerably reduced compared to the usual case of detachment of the label through simply deflecting the material strip at a dispensing edge.

Below, various embodiment of the device according to the invention will now be described.

According to one embodiment it is envisaged that the transporting element has a label contact surface which passes through the dispensing position and the blow-off position or can be brought into the dispensing position and blow-off position and the pressing force generation means are configured in such a way that in the dispensing position and, in particular, during transportation from the dispensing position to the blow-off position, the respective label adheres to the label contact surface. In other words the pressing force generation means are configured so that they produce a friction connection between the label, in particular the side of the label facing away from an adhesive surface, and the label contact surface of the transporting element, more particularly through producing an air flow, more particularly suction air flow, directed perpendicularly to the label contact surface. The suction air flow is produced in particular in that in the label application device, particularly the blower head, an under pressure (lower pressure than the atmospheric/ambient pressure) is generated, for example by means of a fan arranged in the blower head. The label contact surface, to which the respective label is attached by suction in the dispensing position protrudes into or overlaps with the dispensing position so that a label which is still slightly connected to the material strip, can be simultaneously already be sucked onto the label contact surface in order to adhere thereto. The label contact surface then extends to the blow-off position envisaged for the label. The transporting element also extends, in particular, from the dispensing position, in which the label can be transferred (passed on) to the transporting element, to the blow-off position in which the label can be transferred (blown off) from the blower head to the package. The blow-off position is arranged, in particular, underneath (in relation to the direction of gravity) the blower head. Fundamentally it is also conceivable to align the blower head in such a way that the blow-off direction is contrary to the direction of gravity, wherein in this case the blow-off position is arranged above (in relation to the direction of gravity) the blower head and a product is provided with a label in its underside, for example. It is also conceivable to align the blower head in such a way that the blow-off direction is at an angle, more particularly at right angles, to the direction of gravity, wherein in this case the blow-off position is at the side (in relation to the direction of gravity) of the blower head and a label is applied at the side of the product, for example. For different application purposes in one embodiment the blower head in its entirety or the label dispensing device together with the blower head is rotatable about an axis, preferably a horizontal axis.

According to a further embodiment of the device according to the invention, the transport element extends with at least one section in a direction at an angle to the blow-off direction, wherein the section of the transporting element extending at an angle to the blow-off direction extends from the dispensing position preferably to a point of the transporting device which is still at a distance from the blow-off position. Additionally or alternatively it can also be envisaged that with a least one section the transporting element extends in a direction perpendicular to the blow-off direction, wherein the section extending perpendicularly to the blow-off direction extends in particular from the blow-off position to the section of the transporting element extending at an angle to the blow-off position preferably to the point at which the section starting from the dispensing position and extending at an angle to the blow-off position ends. Such a transporting element or such a conveying unit with an oblique section has the advantage the label can be dispensed laterally from a label dispensing device or printing device arranged over the feed device in the direction of the blower head and through the oblique course of the transporting element can be brought closer to the surface of the product to be labelled. Accordingly, in relation to the direction perpendicular to the product surface to be labelled, the blow-off position does not have to be at the same height as the dispensing position or the output slit of the label dispending device, but can be moved nearer to the product surface, through which the distance between the blow-off position and product surface can be minimized. This in turn increases the precision with which the label is applied to the package surface. The label dispensing device can be placed with regard to the direction perpendicular to the feed device over the feed device, preferably at such a large distance that the product can safely pass between the underside of the label dispensing device and the upper surface of the feed device. As the label dispensing device and the blower head are arranged over the feed device, so that the label dispensing device does not have to be placed laterally next to the feed device, the overall width of the device of labelling according to the invention can be minimized.

In accordance with a further embodiment of the device according to the invention, the transporting element, which moves the label from the dispensing position to the blow-off position, is a movable and preferably circulating transport element, and in particular is formed of a continuous belt. In particular the continuous belt comprises a plurality of parallel belts, in particular at least two parallel belts, preferably at least four parallel belts, particularly preferably at least six parallel belts, of which at least two belts are preferably at a distance from one another. Preferably all the belts are at a distance from one another. Each belt is tensioned between two wheels or rollers, of which at least one wheel or one roller is driven. Together the belts form the continuous belt, wherein the upper surface of the belts or continuous belt forms the label contact surface.

According to a further embodiment of the device according to the invention it is envisaged that the conveying unit comprises at least one plate (which can be part of a housing of the label application device and which, in particular, forms the lower side of the housing) and the pressing force generation means have a plurality of suction openings, which are provided in the at least one plate of the conveyor unit and which are in or can be brought into fluidic connection with an under pressure generating unit. The transporting element, in particular the parallel belts, leads past the suction openings, in particular the side of the suction openings facing the feed device, and/or the at least one plate. The transport element or the belts do not cover the suction openings, at least not completely or at least not all the suction openings, so that the suction force can be transferred from the suction openings to the label, whereby the label is pressed (sucked) onto the label contact surface of the transport element or the belts. When using several spaced belts at least some of the suction openings are arranged in such a way that their middle axis and/or projection running in the direction perpendicular to the label contact surface passes through the gap between two adjacent belts and, in particular, does not intersect the belts.

In particular it is envisaged that in a direction perpendicular to the label contact surface the transporting element or the parallel belts extend(s) between the suction openings and the dispensing position and/or between the suction openings and the adhering label (during operation). In order words, in the dispensing position the label is sucked onto the transport element or the belts and, while maintaining the suction force or friction force, is transported to the blow-off position.

Preferably the suction openings are provided along the entire extent of the transporting element between the dispensing position and the blow-off position. In the case of transporting element which as defined above has a section extending at an angle to the blow-off direction and at right angles to the blow-off direction, the suction opening are provided in the area of both sections of the transporting element. The suction openings in the area of the section extending at an angle to the blow-off direction are preferably exclusively for sucking the label to the transporting element, whereas the suction opening in the section of the transporting element running at right angles to the blow-off direction, or at least some of these openings, can, as has been stated by used for blowing off (producing the blast of compressed air). Preferably, however, all the suction options are used exclusively for suction, whereby for blowing off separate blow openings are provided in the blower head. These are used exclusively for blowing. In other words, it is envisaged that at least some of the suction opening form part of the blower head. These can have any kind of cross-sectional shape. One or more of these are, in particular, each designed as a gap in which one or more blow openings/blow nozzles are arranged (i.e. this/these blow opening(s) lie(s) in the plane of the gap) and/or is/are flush with the one or more of the blow openings/blow nozzles in the blow-off direction (i.e. the projection of this/these blow opening(s) pass(es) through the opening of the gap). It is, for example, conceivable that the respective suction opening has the form of a gap, i.e. an elongated cross-sectional shape and several sleeve-shaped (cylindrical) nozzle elements project into this gap. It is also conceivable that in one suction opening only one single blow opening/blow nozzle is arranged and that the suction opening at least in section surrounds the blow opening/blow nozzle or its nozzle element and is of any shape, e.g. annular. The suction opening is of a circular shape for this. The blower nozzles can be or be brought into fluidic connection with an overpressure generating unit. Such an overpressure generating unit is intended for providing a higher pressure than the atmospheric pressure or ambient pressure in the blower head which can be suddenly released through which the blast of compressed air is produced.

The suction openings, which are part of the blower head, are arranged in a plate of the conveyor unit extending perpendicularly to the blow-off direction or in a section of a plate of the conveyor unit (or of the housing of the label application device) extending perpendicularly to the blow-off direction, wherein, in particular, the section of the transport element which extends perpendicularly to the blow-off direction, passes parallel to the plate extending perpendicularly to the blow-off direction or the section of the plate (or of the housing) extending perpendicularly to the blow-off direction.

According to yet another embodiment it is envisaged that the horizontal distance in the label transporting direction (direction of transportation of the label from the dispensing to the blow-off position) between the dispensing position and the suction openings, which form part of the blower head, is unchangeable. This refers to the distance in the direction of a direction component perpendicular to the blow-off direction, i.e. the horizontal distance between the blower head and label dispensing device cannot be changed. However, as has been stated, it can be envisaged that the label application device, including the blower head and conveyor unit can be moved transversely to this direction or direction component—this direction is defined as the transverse direction—in order to also allow alignment in the direction of the label width.

In accordance with another embodiment of the device according to the invention it is envisaged that the label application device comprise rotatable label adjusting means, in particular label adjusting means, rotatable about an axis of rotation parallel to the blow-off direction, which have one or more suction openings, which are or can be brought into fluidic connection with an under pressure generating unit, wherein the transporting element, in particular the parallel belts, passes by the suction openings, in particular the side of the suction openings facing the feed direction. In this way it is possible to again newly adjust a label located between the feed direction and the openings intended for the blast of compressed air. In this way, either small deviations with regard to the optimum alignment of the label which may have occurred during transportation from the dispensing position to the blow-off position, can be corrected or a label can be aligned completely differently with regard to the alignment in the dispensing position, as, for example, a triangular label has to be precisely applied to a package running symmetrically to the transporting axis. In particular, the label adjusting means can be rotated in even steps the range of +/− 180°, for example in steps in a range of 0.5 to 2.5°, preferably in a range of 0.5 to 2°, particularly preferably in a range of 1 to 1.5°.

According to a further embodiment the under pressure generating unit, which is or can be brought into fluidic connection with the suction opening(s) of the rotatable label adjusting means, is different from or identical to the under pressure generating unit which is or can be brought into fluidic connection with the majority of suction openings in the at least one plate of the conveyor unit. The suction openings of the label adjusting means are then also part of the pressing force generation means.

According to another embodiment the rotatable label adjusting means and/or the axis of rotation of the label adjusting means is arranged centrally in the area with the blow and/or suction openings which are part of the blower head (active opening surface or nozzle surface). In particular, for each label, in particular for each label size, the axis of rotation represents the middle of the blow-off position.

Preferably, at the side facing the feed direction, the rotatable label adjusting means have a surface, more particularly a circular or annular surface in which the one or the several suction openings of the label adjusting means are arranged.

According to another embodiment it is envisaged that the rotatable label adjusting means are axially displaceable (supported) along their axis of rotation and, in particular, can be moved between an retraced position in which the rotatable label adjusting means do not cross the plane in which the label contact surface runs, and an extended position in which the rotatable label adjusting means cross (intersect) this plane, where the rotatable label adjusting means is rotatable, at least in the extended position. Preferably, in the event that the label adjusting means can be retracted and extended, is envisaged that in the blow-off direction the individual belts do not cover the label adjusting means, and in particular the surface of the label adjusting means facing the feed direction, so that the label adjusting means can be extended unhindered along their axis of rotation. Fundamentally, for certain applications it can, however, also be envisaged that the individual belts or at least one belt of the transporting element is/are taken over the surface of the label adjusting means facing in the feed direction, wherein in this state the label adjusting means cannot be used for turning a label, but the suction openings of the label adjusting means can be used for suction. However, for a extensive functionality of the device according to the invention as possible it is preferred if the rotatable label adjusting means are not covered by belts and can be extended unhindered. The rotatable label adjusting means can then, as soon as a label is centred with regard to its axis of rotation, can lift the label in the sucked-on state from the other suction openings, in particular in the direction of the feed device and then turn the label into the optimum position for blowing off. In this position, in which the label adjusting means are still extended, the label can already be blown off onto the product surface. Preferably, however, after turning by means of the rotatable label adjusting means, the label is retracted together with the label adjusting means (into the retracted position of the label adjusting means) and only then blown off.

Alternatively it is also conceivable that the rotatable label adjusting means are not axially movable (supported) along their axis of rotation, i.e. are fixed in the axial direction (blow-off direction). It is fundamentally also conceivable to carry out turning of the label without extending the label adjusting means. In this case the label is, as previously described, attached by suction, but through at least some of the blow nozzles/openings of the blower head for a short period (during the rotational movement of the label adjusting means) and preferably with less than the regular blow-off pressure, an air flow is directed onto the label through which it is detached from the transporting element, in particular the continuous belt or the belts. If the label is detached from the transporting belt and simultaneously sucked on by the label adjusting means the label can also easily be turned.

The previously derived and set out task is also solved according to a second aspect in the case of a method of labelling individual products, in particular package or good, preferably using a device as defined above

- in which a product is transported along a transporting path with, in particular on, a feed device,
- in which on the transporting path the product is moved past a blower head of a label application device,
- in which in a label dispensing device labels connected to a material strip are provided,
- in which one of labels is dispensed by the label dispensing device in a dispensing position and detached from the material strip,
- in which the label is taken from the dispensing position to the blower head in a blow-off position and
- in which the label is transferred from the blow-off position to the product by way of a blast of compressed air directed in a blow-off direction from the blow-off position to the feed device as soon as the product is located in front of (under) the blow-off position in the blow-off direction, in that the label is transferred from the label dispensing device in the dispensing position to a conveyor unit and taken by the conveyor unit from the dispensing position into the blow-off position.

As has previously been described, by way of the method according to the invention a label can be optimally aligned with regard to the blower head and the openings located therein in the label dispensing direction or the horizontal direction component. In this way, with simple means adaptation of different label lengths can be achieved with simple means. It can also be envisaged that the entire label application device, including the blower head and the conveyor unit can be displaced in the transverse direction in order to also allow adaptation to different label widths.

In particular, on its path from the dispensing position to the blow-off position the label passes through a position (intermediate position) in which the label is connected to neither the label dispensing device or the material strip, nor (in relation to the blow-off direction) is arranged in front of one of the openings of the blower head through which the blast of compressed air for transferring the label to the product later emerges. In this way the transporting element or the distance between the dispensing position and blow-off position is sufficiently long to overcome a relatively large difference in height (in relation to the blow-off direction) between the label output slit and blow-off position. At the same time, due to the great length of the path between the dispensing position and blow-off position, a section of the transport element can also be used as an intermediate buffer in which a label can already be arranged, while another label is at this point in time being transferred onto the product surface in the blow-off position by a blast of compressed air.

According to another embodiment of the method according to the invention it is envisaged that in the dispensing position, in the blow-off position and in particular during its transportation from the dispensing position into the blow-off position the label is pressed by a suction air flow to a label contact surface of a transporting element of the conveyor unit, wherein the suction air flow is directed in the direction from the label to the label contact surface. A suction air flow is in particular produced in defined (i.e. predetermined) intervals, in particular at regular intervals along the entire path of the label from the dispensing position to the blow-off position. In other words a suction air flow is produced by several suction openings arranged along the entire path of the label from the dispending position to the blow-off position.

According to a further embodiment of the method according to the invention, as described above, in the blow-off position the label is turned about an axis of rotation parallel to the blow-off direction before it is transferred (by the blast of compressed air) to the product. In particular, it is envisaged that during turning of the label about the axis of rotation the label is sucked and held by label adjustment means bringing about the rotation, wherein at the same time an air flow is in particular directed in the blow-off direction onto the label in an area around the label adjusting means. As has already been described, the air flow in the blow-off direction also turning of the table without the need to extend the label adjusting means.

Figure 2:
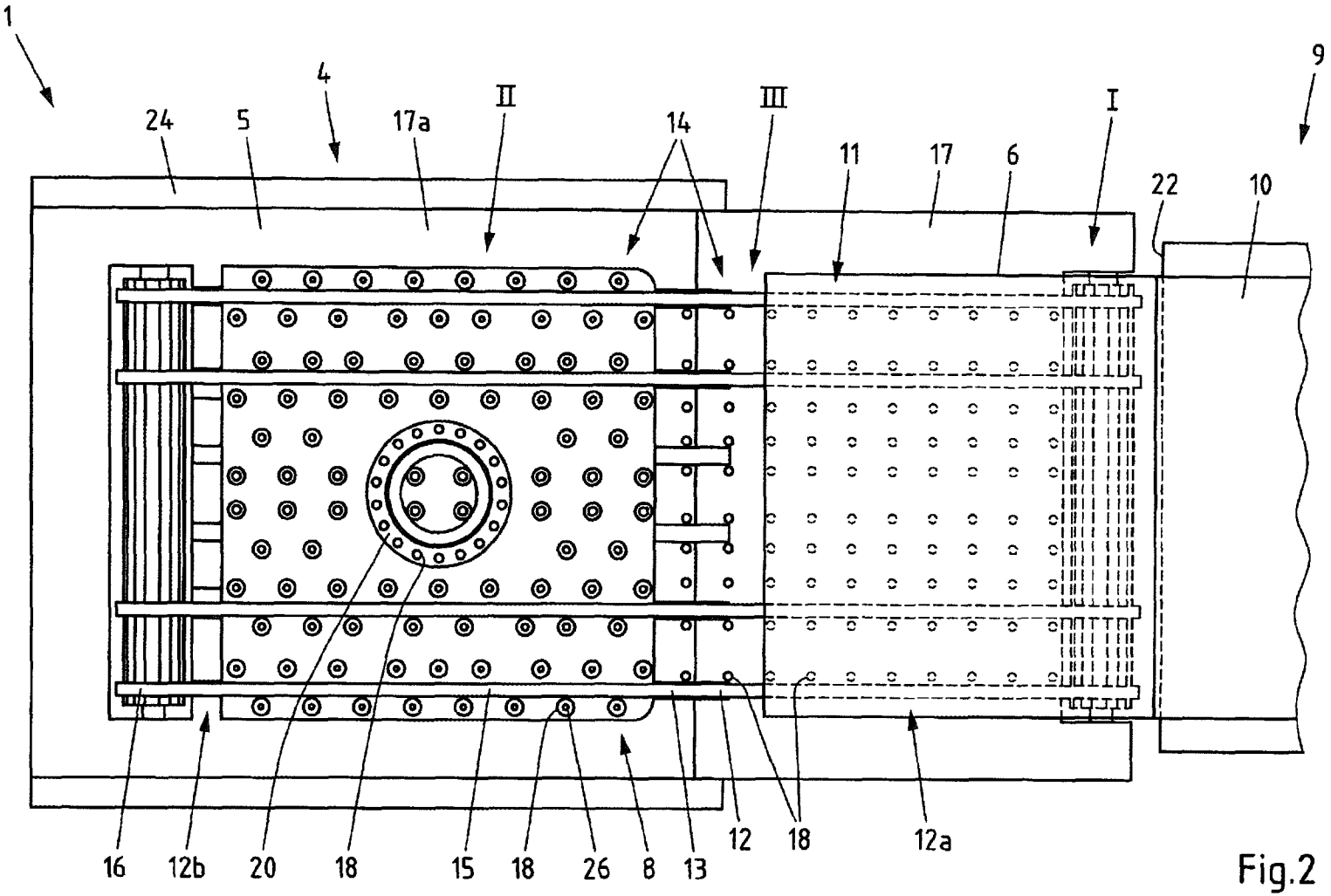
Figure 3:
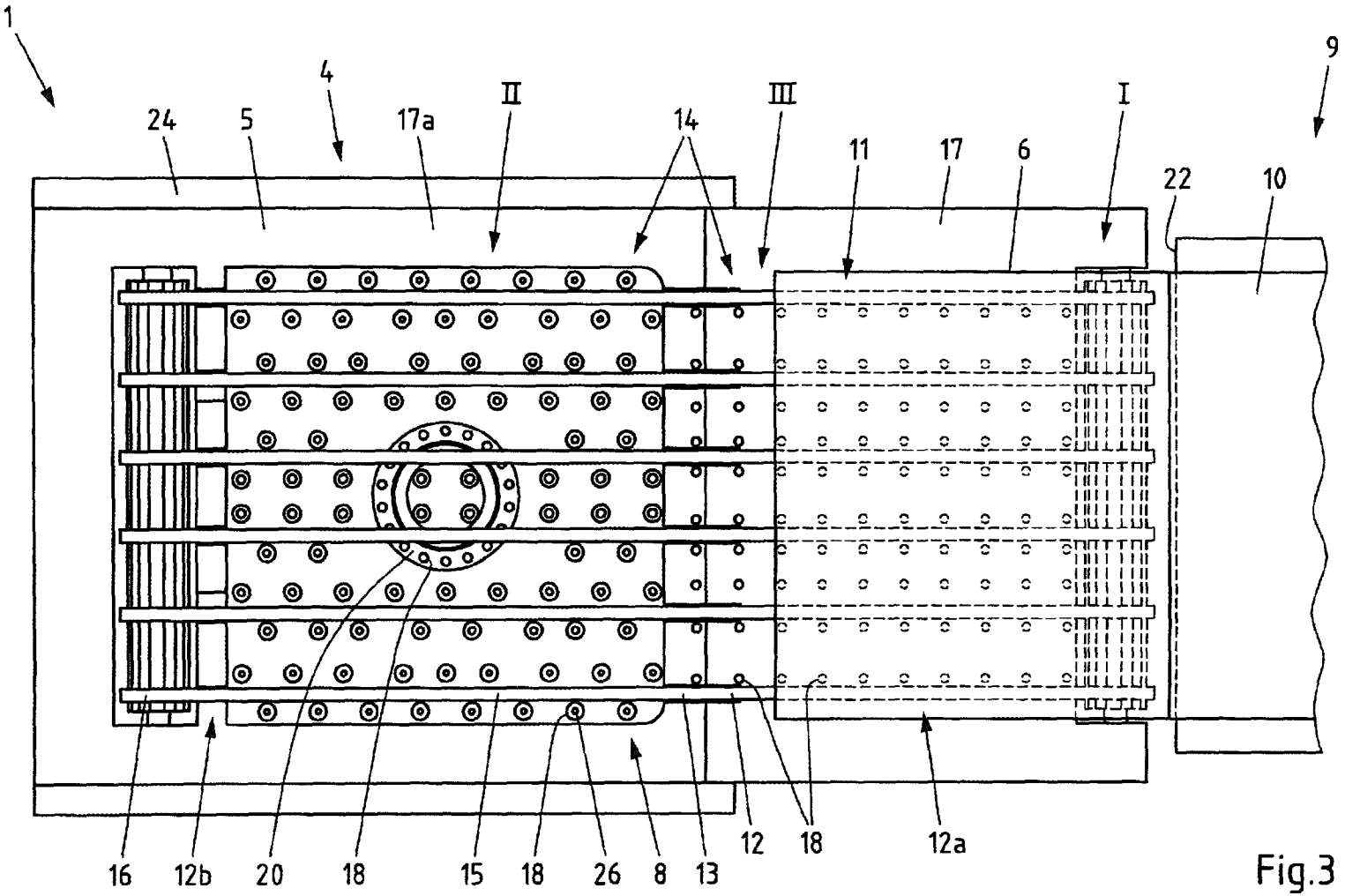

There are a number of possibilities of designing and further developing the device as well as the method according to the invention. With regard to this reference is made on the one hand to the claims subordinate to claims 1 and 17, and on the other hand to the description of examples of embodiment in connection with the drawings. In the drawing:

FIG. 1 shows a schematic side view of a device for labelling individual products, FIG. 2 shows a perspective view of a part of the device in FIG. 1 in a first embodiment and FIG. 3 shows a perspective view of the part shown in FIG. 2 in an alternative embodiment.

FIG. 1 shows a side view of one example of embodiment of a device 1 for labelling individual products 2 (here packages), wherein the device 1 comprises a feed device 3 for transporting the respective product 2 along a transporting path, a label application 4 for applying a label 6 to the upper side of the product 2 and finally a label dispensing device 9 which here also serves to print the respective labels 6.

The feed device 3 transports a product 2 in a product conveying direction X wherein in this example of embodiment the feed device 3 is in the form of a conveyor belt. Fundamentally the feed device 3 can also be designed in a different manner. In the product conveying direction X the label dispensing device 9 lies before the label application device 4, wherein both the label dispensing device 9 and the label application device 4 are both arranged in sections in the direction of gravity G above the feed device 3. In this way the product 2 is conveyed in the product conveying direction X first under the label dispensing device 9 and then under the label application device 4. In doing so the product can be conveyed in a synchronized manner wherein continuous conveying is preferred.

The label application device 4 is provided with a blower head 5 for applying a label 6 to the surface of the product 2. The blower head 5 has holding means 7 for fixing the label in a blow-off position II. The holding means 7 consist of suction openings 18 and in fluidic connection therewith an under pressure generating unit 19 for product a suction flow. The blow-off position II is position from which the label can by transferred by way of a blast of compressed air to the surface of the product 2. In the blow-off position II the blast of compressed air acts on at least one section of a label 6 and preferably the center of the entire label 6. In order to produce such a blast of compressed air the blower head 5 has blow-off means 8, in this case, for example, cylindrical sleeves ("nozzle bodies") with blow openings 26 which are arranged concentrically to the suction openings 18, as well as an overpressure generating unit (not shown) which is then in fluidic connection with the cylindrical nozzle bodies or blow openings 26 through which the blast of compressed air can be directed in a blow-off direction A which extends from the blow-off position II to the feed device 3. Here the suction openings 18 are each formed by a gap into which the nozzle bodies project or with which the nozzle bodies and thus the blow openings 26 are flush. Through the gap a continuous suction air flow is produced to hold the label 6 in the blow-off position II through suction. For blowing off the label 6, without, in particular, interrupting the suction air flow through the suction openings 18, a blast of compressed air is produced through the nozzle bodies and blow openings 26 in the blow-off direction A.

Here, the cross-section of the suction openings 18 is only as an example circular and the blow openings 26 are only circular as an example. The outer contour of the openings 18 and 26 can in principle be of any shape. In particular it can also be envisaged that one or more of the suction openings 18, which are part of the blower head 5, are each designed as a gap in which one or more of the separate blow openings 26 are arranged and/or with which one or more of the separate blow openings 26 are flush. Additionally or alternatively it can also be envisaged that one or more of the suction openings 18 which form part of the blower head 5 at least partially surround a single blow opening 26.

The label dispensing device 9 is configured to provide a label which is partially detached from the material strip 10 in a dispensing position I. The dispensing position I is defined as a position in which said label 6 is partially detached from the material strip 10, i.e. still partially adheres thereto, and at the same time overlaps part of the label application device 4, namely a conveyor unit 11 still to be described in more detail below, and from this is sucked onto a label contact surface 13 of a transporting element 12. The label dispensing device 9 here has a label roll feed 21 for holding and unrolling a material strip 10 (also known as a label strip) containing a label 6 and a label detaching mechanism 22, here in the form of a dispensing edge for deflecting the material strip 10. It is pointed out that the labels 6 can be applied (adhered) to the material strip detachably or can themselves form the material strip 10 (carrier-less or liner-less labels).

An essential feature of the present device 1 according to the present invention is the already mentioned conveyor unit 11 which is part of the label application device 4 and serves to transport the respective label 6 from the dispensing position I to the blow-off position II. The conveyor unit 11 has a transport element 12 and pressing force generation means 14 which both interact with each other so that a label 6 can be moved by the conveyor unit 11 from the dispensing position I to the blow-off position II. This permits the distance b in the label dispensing direction S between the dispensing position I and the part of the suction openings 18 that are part of the blow head 5 to be unchangeable. On the other hand the entire label application device 4 can be displaced in the direction perpendicular to the label dispensing direction A and the blow-off direction A.

The label dispensing device 9 has a lateral ejection slit facing the label application device 4 from which a label 6 emerges in a label dispensing direction S. In the area of the ejection slit 23 the label dispensing device S is parallel to the product conveying direction X wherein, however, the label 6, when emerging from the ejection slit 23, is deflected in a direction $B_1$ at an angle to the blow off direction A by a part of the label application device 4, namely said conveyor unit 11.

In the present example of embodiment, as alternatively shown in FIGS. 2 and 3 the transport element 12 comprises several parallel, circulating belts 16 which together form a continuous belt 15. According to the example of embodiment in FIG. 2 four belts 16 and according to the example of embodiment in FIG. 3 six belts 16 are arranged. The outer surface of the belts 16 or the continuous belt 15 forms a label contact surface 13 which passes through the dispensing position I and the blow-off position II. Here it only partially passes through the dispensing position I, but completely through the blow-off position II.

As described above, the pressing force generation means 14 produce an under pressure so that during transportation from the dispensing position I to the blow-off position II the respective label 6 adheres to the label contact surface 13.

As can be clearly seen in FIG. 1, in a first section 12*a* the transport element 12 designed as a continuous belt 15 extends in a direction $B_1$ at an angle to the blow-off position A and in a second section in a direction perpendicular to the blow-off direction A. At an obtuse angle the angled section 12*a* becomes the angled section 12*b* perpendicular to the blow-off direction A. Through the angled section 12*a* the difference in height (in the blow-off direction A) between the election slit 12 and the blow-off position II can be bridged.

As shown in FIGS. 2 and 3, the conveyor unit 11 has a plate 17 which forms part of the housing 24 of the label application device 4, in this case the underside. Here the plate 17 is bent and has two section which determine the course of the two sections 12*a* and 12*b* of the transporting element 12. Provided in the plate 17 are several suction openings 18 which are part of the pressing force generation means 14 and are in fluidic connection with the under pressure generating unit 19, which has a fan 25. The parallel belts 16 pass the suction openings 18 in such a way that the suction openings 18 can bring about a suction air flow perpendicular to the surface of the plate 17 in the direction of the interior of the blower head which presses the label 6 to the belts 17. In this way a label 6 can be conveyed from the dispensing position shown in FIGS. 2 and 3 to the blow-off position II.

Some of the suction openings 18 are arranged in the area of the cylindrical sleeves 26 which, as described above, service to produce the blast of compressed air in the blow-off direction A. In FIGS. 2 and 3 the last part of the suction openings 18 is designed in the form of annular openings around the cylindrical sleeves 26. On the other hand the suction openings 18 in the area of the angled section 12*a* of the transporting element 12 are designed as holes (bore) in the respective section of the plate 17. Fundamentally, however, suction openings 18 are arranged along the entire extent of the transporting element 12 between the dispensing position I and the blow-off position II.

Finally, in FIGS. 2 and 3 rotatable label adjusting means 20 are shown which allow a label 6 to be held by suction via suction openings 18 provided in the surface of the label adjusting means 20 facing the feed direction 3 and to be turned in the suction-held state about an axis of rotation. To produce the suction force, the suction openings of the label adjusting means 20 are for example in fluidic connection with a separate under pressure generating unit (not shown), but can alternatively also be connected with the previously described under pressure generating unit 19 which has a fan 25. In the example of embodiment shown in FIG. 2 the label adjusting means 20 can be extended downwards out of the housing 24 with a label 6 attached by suction, the label adjusting means 20 can then be rotated +/− 180° about the axis of rotation d, here in 1° steps for example, and finally the label adjusting means 20 can be retracted again so that the label 6 can be blown off onto the product 2 in the position now changed through rotation.

In the example of embodiment in FIG. 3 some of the belts 12 extend in the blow-off direction A over the label adjusting means 20 so that in this case the label adjusting means 20 can only be used for suction, but not for turning a label 6.

In order to now provide a label 6 on the upper side of the product, according to the invention the following processing steps are carried out:

First of all a product 2 is transported on the feed device 3 along a transporting path, which here passes under the label dispensing device 9 and then under the label application device 4.

In doing so the product is taken past a blower head 5 of the label application device 4.

Prior to this a label 6 has already been dispensed by means of the label dispensing device 9 to the dispensing position I and detached from a material strip.

The label 6 is conveyed from the dispensing position I to the blower head 5 to an blow-off position II wherein the label 6 from the label dispensing device 9 in the dispensing position I is initially transferred to the conveyor unit 11 and transferred by this from the dispensing position I to the blow-off position II. On its path the label 6 also passes through an intermediate position III in which the label 6 is neither connected to the label dispensing device 9 or the material strip 10, nor is arranged in the effective area of the blast of compressed air.

It can optionally be envisaged that the label 6 is turned by means of label adjusting means 20 about an axis of rotation d running parallel to the blow-off direction A, for example in 1 to 1.5° steps over a range of +/− 180°. For this the label adjusting means 20 are axially movable along the axis of rotation d between a retracted position, in which the label adjusting means 20 do not cross the plane E in which the label contact surface extents, and an extended position used for turning, in which the label adjusting means 20 pass through this plane E.

Finally the label 6 is transferred to the product 2 from the blow-off position II by means of a blast of compressed air directed in the blow-off direction A as soon as in the blow-off direction A the product 2 is located under the blow-off position II.

The invention claimed is:

1. A device for labelling individual products being transported along a transporting path comprising a label application device with a blower head for applying a label to a surface of a respective product, wherein the blower head has holding means for fixing the label in a blow-off position and blow-off means for producing a blast of compressed air directed in a blow-off direction from the blow-off position toward the product, wherein the label application device comprises a conveying unit for transporting the label from a dispensing position to the blow-off position, wherein the conveying unit comprises a transporting element and pressing force generation means, wherein the label application device comprises separate label adjusting means rotatable about an axis of rotation parallel to the blow-off direction, which has one or more suction openings which are in fluid connection with, or are configured to be brought into fluidic connection with, an under pressure generating unit, and wherein the transporting element leads past the suction openings.

2. The device according to claim 1, wherein the transporting element comprises a label contact surface which passes through the dispensing position and the blow-off position or is configured to be brought into the dispensing position and the blow-off position, and wherein the pressing force generation means is configured in such a way that in the dispensing position the label adheres to the label contact surface.

3. The device according to claim 1, wherein in at least a first section the transporting element extends in a direction that is at an angle to the blow-off direction, and wherein the first section of the transporting element extending at the angle to the blow-off direction extends from the dispensing position.

4. The device according to claim 3, wherein at least in a second section the transporting element extends in a direction perpendicular to the blow-off direction, and wherein the second section extending perpendicular to the blow-off direction extends from the blow-off position to the section extending at the angle to the blow-off direction.

5. The device according to claim 1, wherein the transporting element is movable.

6. The device according to claim 5, wherein the transporting element is a circulating transporting element that consists of a plurality of parallel continuous belts of which at least two belts are spaced apart a distance from one another.

7. The device according to claim 6, wherein the conveying unit comprises at least one plate, wherein the at least one plate includes a plurality of suction openings, wherein the suction openings provided in the at least one plate are in fluidic connection with the under pressure generating unit, and wherein the parallel belts lead past suction openings facing the transporting path.

8. The device according to claim 7, wherein the suction openings are provided along an entire extent of the transporting element between the dispensing position and the blow-off position.

9. The device according to claim 7, wherein some of the suction openings form part of the holding means and blow-off means of the blower head, and wherein one or more blow nozzles is arranged within one or more of the suction openings.

10. The device according to claim 9, wherein the suction openings, which are part of the holding means and blow-off means of the blower head, are arranged in the plate of the conveying unit extending perpendicularly to the blow-off direction or a section of the plate of the conveying unit extending perpendicularly to the blow-off direction, and wherein the second section of the transporting element which extends perpendicular to the blow-off direction passes parallel to the plate extending perpendicular to the blow-off direction or the section of the plate extending perpendicular to the blow-off direction.

11. The device according to claim 9, wherein a distance in a direction of transporting of the label between the dispensing position and the suction openings, which are part of the holding means and blow-off means of the blower head, is unchangeable.

12. The device according to claim 7, wherein the under pressure generating unit which is or is configured to be brought into fluidic connection with the suction openings of the rotatable label adjusting means is different from or identical to the under pressure generating unit which is or configured to be brought into fluidic connection with a majority of suction openings in the at least one plate of the conveying unit.

13. The device according to claim 9, wherein the rotatable label adjusting means and/or the axis of rotation of the label adjusting means is/are arranged centrally in an area with the suction openings and the blow nozzles which are part of the holding means and blow-off means of the blower head.

14. The device according to claim 1, wherein on a side facing the transporting path the label adjusting means has a surface in which one of more suction openings of the label adjusting means are arranged.

15. The device according to claim 1, wherein the rotatable label adjusting means is axially movable along the axis of rotation and is movable between a retracted position in which the rotatable label adjusting means does not intersect a plane in which a label contact surface extends, and an extended position in which the rotatable label adjusting means intersect the plane, and wherein the rotatable label adjusting means is at least rotatable in the extended position.

16. A method of labelling individual products using a device according to claim 1, the method comprising:

transporting a product along the transporting path,;

moving the product on the transporting path past the blower head of the label application device;

providing labels connected to a material strip;

dispensing one of the labels in a dispensing position and detaching the one of the labels from the material strip;

positioning the label dispensed from the dispensing position to the blower head into a blow-off position;

transferring the label from the blow-off position to the product by a blast of compressed air directed in a blow-off direction from the blow-off position to the transporting path as soon as in the blow-off direction the product is in front of the blow-off position;

conveying the label from the dispensing position to the blow-off position by the conveying unit; and rotating the label in the blow-off position about the axis of rotation parallel to the blow-off direction before it is transferred to the product, wherein during rotation of the label about the axis of rotation the label is sucked on and held by the separate label adjusting means bringing about the rotation.

17. The method according to claim 16, wherein in the dispensing position, in the blow-off position and during transport from the dispensing position to the blow-off position the label is pressed by a suction air flow to a label contact surface of the transporting element of the conveying unit, and wherein the suction air flow is directed in a direction from the label to the label contact surface.

18. The method according to claim 17, wherein the suction air flow is produced at defined intervals, along an entire path of the label from the dispensing position to the blow-off position.

19. The method according to claim 17, wherein an air flow is directed in the blow-off direction in an area around the label adjusting means onto the label at the same time as the suction air flow is directed in the direction from the label to the label contact surface.

* * * * *